US005223856A

United States Patent [19]

Kawata et al.

[11] Patent Number: 5,223,856

[45] Date of Patent: Jun. 29, 1993

[54] THERMAL HEAD

[75] Inventors: Akihiro Kawata; Ryoichi Shiraishi; Shigenori Ota, all of Aira, Japan

[73] Assignee: Kyocera Corporation, Kyoto, Japan

[21] Appl. No.: 740,291

[22] Filed: Aug. 5, 1991

[30] Foreign Application Priority Data

Aug. 7, 1990 [JP] Japan ..... 2-209551

[51] Int. Cl.[5] ..... B41J 2/335

[52] U.S. Cl. ..... 346/76 PH

[58] Field of Search ..... 346/76 PH

[56] References Cited

U.S. PATENT DOCUMENTS 4,680,593 7/1987 Takeno et al. ..... 346/76 PH
5,028,935 7/1991 Warmack et al. ..... 346/76 PH

FOREIGN PATENT DOCUMENTS 35138 3/1976 Japan .
54-87748 6/1979 Japan .
6048375 3/1985 Japan .
61-44892 3/1986 Japan .
61-140844 9/1986 Japan .
62-37737 9/1987 Japan .
63-221055 9/1988 Japan .
6478859 3/1989 Japan .
6478860 3/1989 Japan .
0290454 11/1989 Japan .
1175828 12/1989 Japan .
0212157 8/1990 Japan .

*Primary Examiner*—Benjamin R. Fuller
*Assistant Examiner*—Huan Tran
*Attorney, Agent, or Firm*—Spensley Horn Jubas & Lubitz

[57] ABSTRACT

When the support member and cooling member of the thermal head are made of aluminum, and the head substrate is made of ceramic, the difference in the coefficient of thermal expansion of the two is very large, and the aluminum is expanded in use, and the gap to the adjacent head substrate is increased to cause white stripes. In the invention, the materials are properly selected so that the coefficient of thermal expansion of the support member and cooling member and the coefficient of thermal expansion of the head substrate may be close to each other, and the head substrate is adhered to the cooling plate with a soft adhesive. Therefore, if a difference is caused in the amount of expansion between the head substrate and the cooling plate during use, it is suppressed to such an extent as to be absorbed by the elastic deformation of the soft adhesive.

24 Claims, 9 Drawing Sheets

THERMAL HEAD

BACKGROUND OF THE INVENTION

1. Field of the Invention

The present invention relates to a thermal head, and more particularly to a long-spanning thermal head constructed by combining a plurality of head substrates matching with the alignment direction of heating resistance elements arranged linearly on head substrates.

2. Description of the Prior Art

FIG. 1 is a sectional view of a typical conventional thermal head. For example, when thermal printing is attempted in the longitudinal direction of recording paper of A2 format of Japan Industrial Standards as the principal scanning direction, about 600 mm is required as the overall length of the thermal head 1, that is, the printing with W1 in the principal scanning direction. It is difficult to form a small heating resistance element 5 with uniform temperature characteristic over 600 mm on a single head substrate made of, for instance, ceramic. Hitherto, therefore, for example, two head substrates 2, 3 having a printing width W2 of about 300 mm are combined.

Such head substrates 2, 3 are composed of, for example, ceramic, of which coefficient of thermal expansion is $$\alpha A = 0.73 \times 10^{-5} \cdot C^{-1} \quad \ldots (1)$$

Such head substrates 2, 3 are individually affixed to cooling plates 6, 7 in a size corresponding to the head substrates 2, 3 through a soft adhesive layer 4. The cooling plates 6, 7 are composed of a metallic material excellent in thermal conduction, and in the case of aluminum, the coefficient of thermal expansion is $$\alpha B = 2.37 \times 10^{-5} \cdot C^{-1} \quad \ldots (2)$$

The end face 2*a* at the head substrate 3 side of the head substrate 2 and the end face 6*a* of the cooling plate 7 side of the cooling plate 6 are composed flush, and the end face 3*a* of the head substrate 2 side of the head substrate 3 and the end face 7*a* of the cooling plate 6 side of the cooling plate 7 are also formed flush.

Such cooling plates 6, 7 are fixed in the central position in the principal scanning direction of the cooling plates 6, 7, to support plate 8 made of aluminum or the like by screws or the like. That is, the fixing positions 9, 10 of the cooling plates 6, 7 to the support plate 8 are located at a distance of W2/2 from the central position CN relating to the principal scanning direction of the support plate 8 at the location of the end faces 6*a*, 7*a* of the cooling plates 6, 7.

The support plate 8 is made of aluminum, and possesses the coefficient of thermal expansion $\alpha B$. Here, the difference in the coefficient of thermal expansion is $$\alpha B - \alpha A = 1.64 \times 10^{-5} \cdot C^{-1} \quad \ldots (3)$$

Or the cooling plates 6, 7 and support plate 8 may be made of iron, and the coefficient of thermal expansion $\alpha C$ of such iron is $$\alpha C = 1.40 \times 10^{-5} \cdot C^{-1} \quad \ldots (4)$$

and the difference from the coefficient of thermal expansion $\alpha A$ is $$\alpha C - \alpha A = 0.67 \times 10^{-5} \cdot C^{-1} \quad \ldots (5)$$

FIG. 2 is a sectional view for explaining the problems of this prior art. For example, the thermal head 1 changes from ordinary temperature of 25° C. to high temperature to 90° C. along with the thermal printing action, assuming that the cooling plates 6, 7 and support plate 8 are made of iron, the fixing positions 9, 10 of the support plate 8 and the cooling plates 6, 7 are dislocated in the mutually departing directions by the variations x3a, x3b as shown in FIG. 2. On the other hand, the cooling plates 6, 7 fixed in the fixing positions 9, 10 of the support plate 8 is dislocated in the mutually departing direction from the central position CN are expanded by the variations x2a, x2b from the fixed positions 9, 10. The head substrates 2, 3 are similarly expanded by the variations x1a, x1b.

According to the experiment by the present inventor, in such prior art, the results of measurement as shown in Table 1 were obtained.

TABLE 1

| | Substrate | | Cooling plate | | Support plate | |
|---|---|---|---|---|---|---|
| | x1a | x1b | x2a | x2b | x3a | x3b |
| Coefficient of thermal expansion (°C.$^{-1}$) | $0.73 \times 10^{-5}$ | | $1.40 \times 10^{-5}$ | | | |
| Elongation (μm) | −71.2 | −71.2 | −136.5 | −136.5 | +136.5 | +136.5 |

It is known from Table 1 that the interval W3 between the head substrates 2, 3 is extended by $$W3 = x3a + x1a + x3b + x1b = 130.6\ \mu m \quad \ldots (6)$$

This extending amount is a length more than 1 dot if the density of the small heating resistance element formed along the principal scanning on the head substrates 2, 3 by the thermal head is 8 dots per 1 mm, that is, 125 μm pitch, and therefore an unprinted white stripe is left over on the recording paper, or a white-out phenomenon occurs. Such white-out seriously lowers the printing quality.

FIG. 8 is a plane view of a head substrate 2. On the head substrate 2, the heating resistance element 5 is formed linearly, and the length W2 along the principal scanning direction of this heating resistance element 5 is the printing width W2. The present inventor measured the degree of warp in the thicknesswise direction (the vertical direction to the sheet of paper in FIG. 8) of the head substrate 2 due to temperature rise at five observation points P1 to P5 at mutually equal intervals. The results of observation are shown in Table 2.

TABLE 2

| Cooling plate material | Temperature change | Variation of warp due to temperature change (μm) | | | | |
|---|---|---|---|---|---|---|
| | | P1 | P2 | P3 | P4 | P5 |
| Aluminum cooling plate | 25° C. ↓ 90° C. | 0 | −29 | −53 | −33 | 0 |

The mode of change is as indicated solind line L1 in FIG. 9. Generation of such warp is same as in the head substrate 3.

When such head substrates 2, 3 are used, the head substrates 2, 3 are warped due to temperature rise in use, and when the head substrates 2, 3 perform thermal printing, the pressing force of pressing the platen roller to the thermal paper, for example, is not uniform in the principal scanning direction, which may result in uneven printing.

SUMMARY OF THE INVENTION

It is hence a primary object of the invention to solve the above technical problems and present a thermal head capable of equalizing thermal printing action of high quality regardless of temperature changes.

To achieve the above object, the invention presents a thermal head characterized by fixing a plurality of cooling members on a support member, and fixing head substrates on which multiple heating resistance elements are arranged individually to the cooling members, in which the relation between the coefficient of thermal expansion $\alpha$ of the head substrate and the coefficient of thermal expansion $\gamma$ of the support member is as follows:

$$0.8 \leqq \alpha\tau \leqq 1.2$$

According to the invention, using plural head substrates having multiple heating resistance elements disposed on the surface, cooling members are adhered to the opposite side surface of the heating resistance elements of the head substrates. The cooling plates are disposed on the support member along the alignment direction of the heating resistance elements. Here, the coefficient of thermal expansion $\alpha$ of the head substrate and the coefficient of thermal expansion $\gamma$ of the support member are selected in the relation of $$0.8 \leqq 2/\alpha \leqq 1.2$$

The interval of the plural head substrates is determined by the expansion of contraction amount due to temperature changes of the support member, that is, by the moving extent of each head substrate due to this expansion or contraction and the expansion or contraction amount due to thermal changes of the head substrate itself. Therefore, when the coefficients of thermal expansion $\alpha$, $\gamma$ of the head substrate and support member fulfill the above relation, the interval of the plural head substrates maintains an interval nearly equal to the interval set preliminary at ordinary temperature. It is therefore effect to prevent occurrence of the region not responsible for printing due to expansion of the interval of the head substrates due to, for example, temperature rise. Or, if a gap is produced at the cooling plate side of the head substrate due to temperature rise, it is possible to prevent printing with lowered contrast due to insufficient cooling action of the heating resistance elements on the end substrate corresponding to such gap.

Thus, according to the invention, the head substrates are disposed on the support member along the alignment direction of heating resistance elements. Here, the first coefficient of thermal expansion of the head substrate and the third coefficient of thermal expansion support member are selected to be nearly equal to each other, while the second coefficient of thermal expansion of cooling member is nearly equivalent or superior to the first coefficient of thermal expansion. The interval of plural head substrates is determined by the expansion or contraction amount due to temperature changes of the support member, that is, by the expansion or contraction amount by thermal changes of the head substrate itself and the moving amount of each head substrate due to expansion or contraction. Therefore, when the coefficient of thermal expansion of the head substrate and support member is defined in the above expression, the interval of plural head substrates maintains the interval nearly equal to the interval set preliminarily at ordinary temperature. Accordingly, it is effective to prevent occurrence of region not responsible for printing due to expansion of the interval of the head substrates due to, for example, temperature rise. For example, if the gap is reduced at the cooling member side of the head substrate at the time of temperature rise, it is effective to prevent printing action with lowered contrast due to insufficient cooling action of the heating resistance elements on the head substrate corresponding to the gap.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
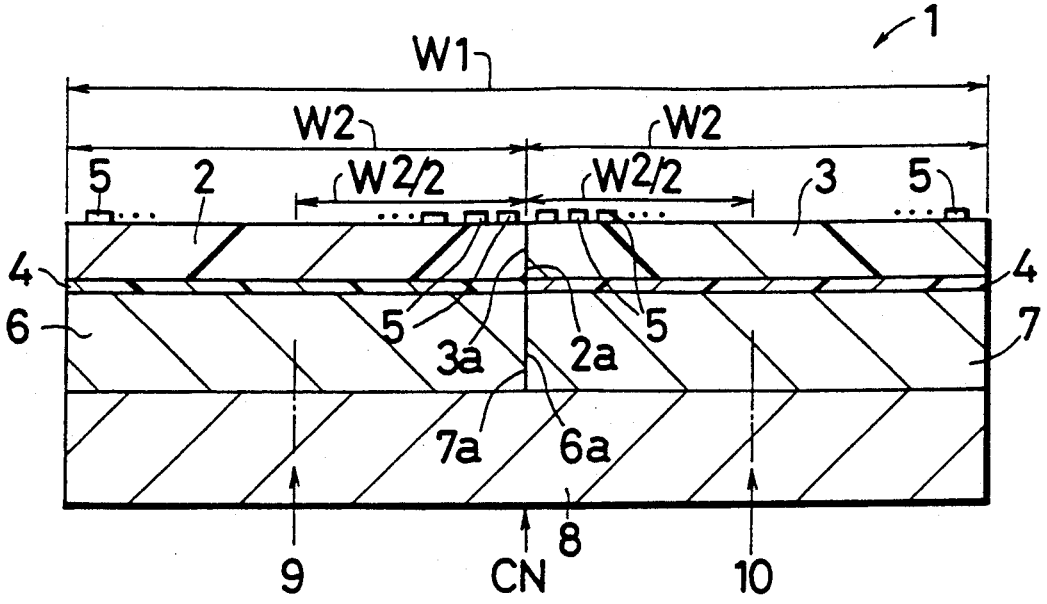
FIG. 1 is a sectional view of a typical conventional thermal head 1.
Figure 2:
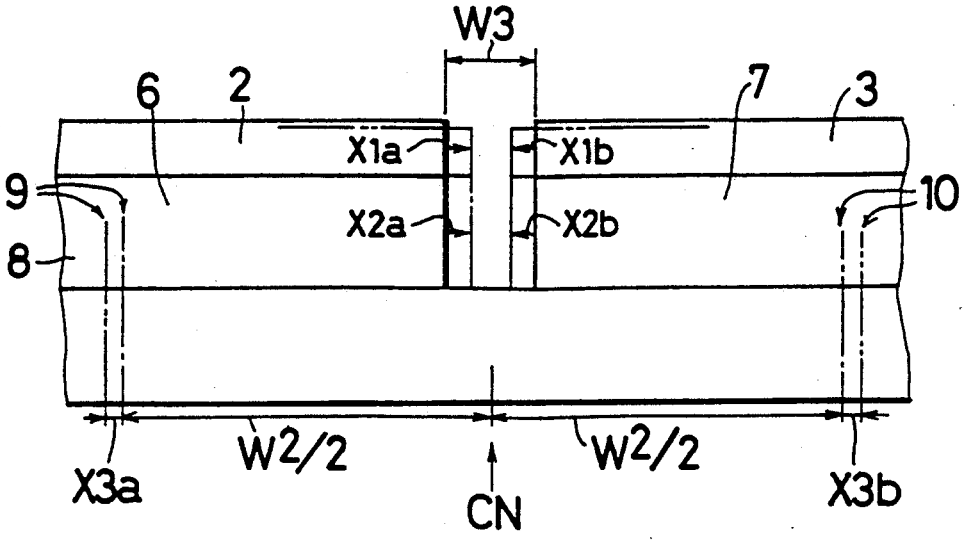
FIG. 2 is a front view near the central position CN of the thermal head 1.

Now referring to the drawing, preferred embodiments of the invention are described below.

Figure 3:
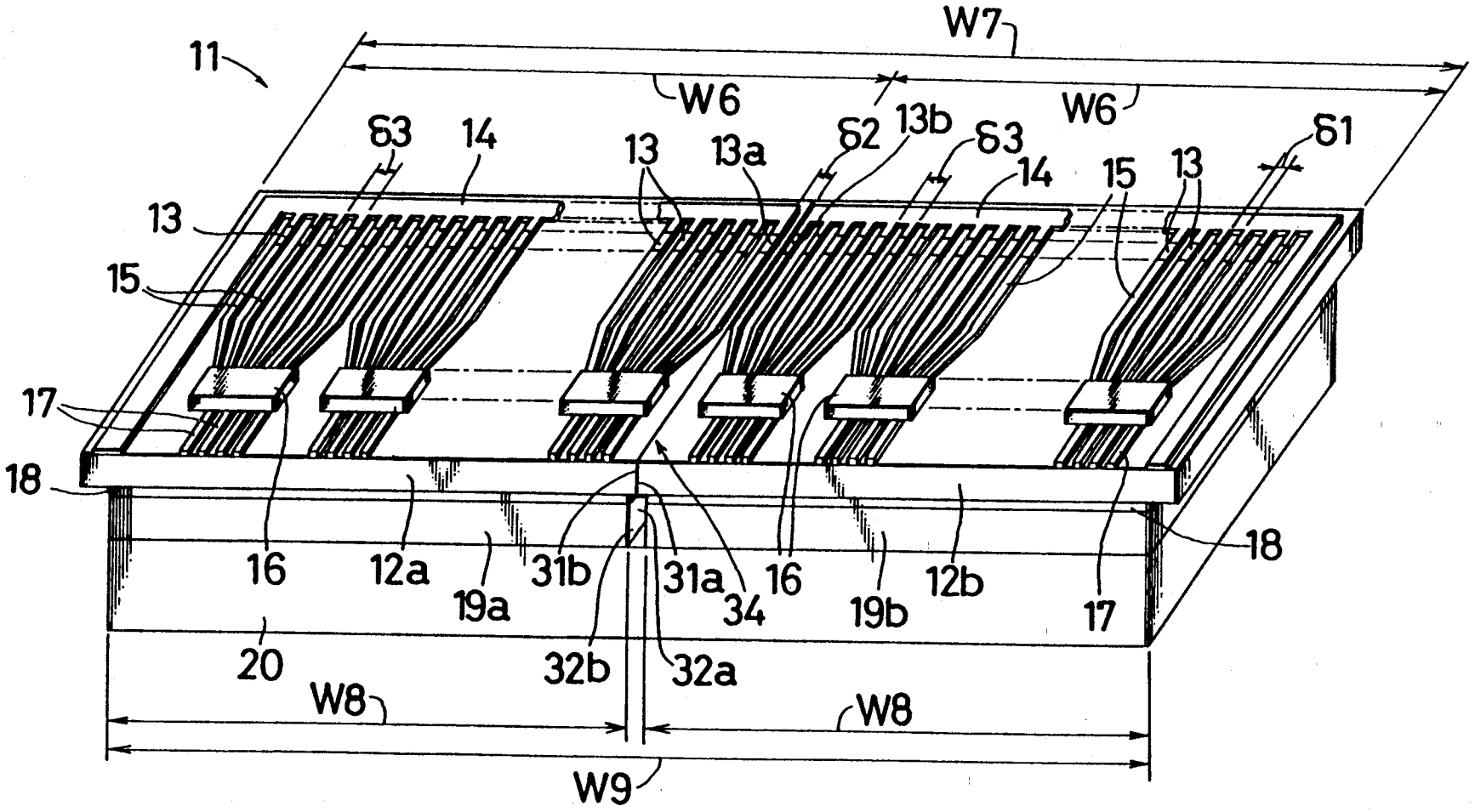
FIG. 3 is a perspective view of a thermal head 11 in an embodiment of the invention.
Figure 4:
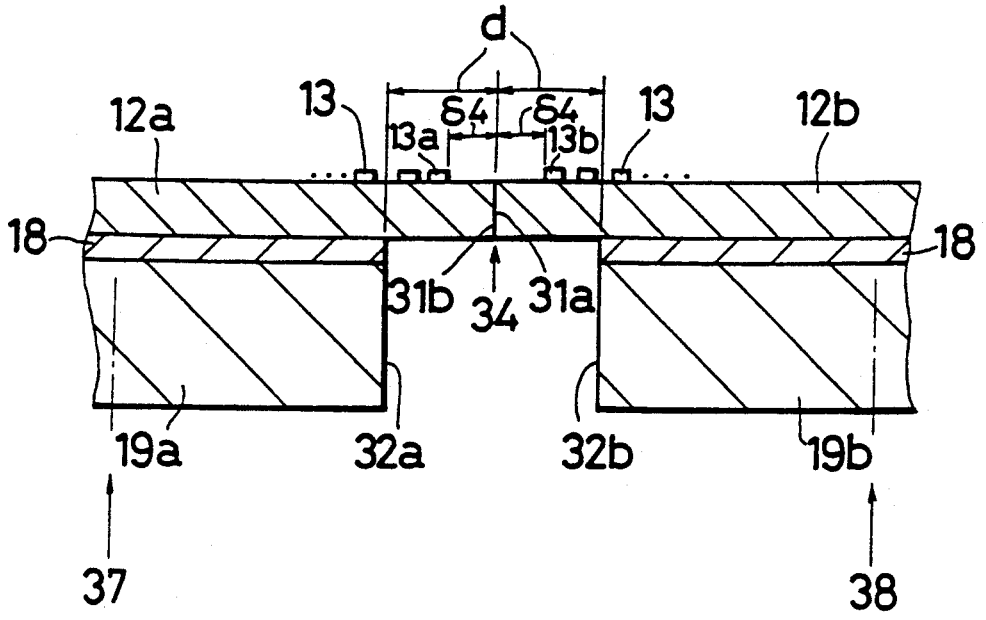
FIG. 4 is a magnified sectional view near an abutting position 34 of the thermal head 11.

FIG. 3 is a perspective view of a thermal head 11 in an embodiment of the invention, and FIG. 4 is a sectional view near the central position 34 along the principal scanning direction of the thermal head 11. The thermal head 11 is made of, for example, ceramics such as aluminum oxide $Al_2O_3$, in a rectangular form in a width of W6 along the principal scanning direction (for example, 300 mm), and comprises head substrates 12*a*, 12*b* with the coefficient of the ram expansion of $\alpha A = 0.73 \times 10^{-5} \cdot C^{-1}$. On each one of the head substrates 12*a*, 12*b*, for example, plural heating resistance elements 13 made of tantalum nitride $Ta_2N$, nichrome Ni—Cr, and ruthenium oxide $RuO_2$ are formed by thin film technology such as evaporation and sputtering, thick film technology such as screen printing, or etching technology, linearly at alignment interval of $\delta 1$ (for example, about 20 $\mu$m) and in alignment pitch of $\delta 3$ (for example, about 40 $\mu$m), at a distance of $\delta 4$ (for example, 10 $\mu$m) from the end faces 31*a*, 31*b* of the head substrates 12*a*, 12*b*.

The heating resistance element 13 performs thermal printing on thermal recording paper or thermal film and recording pater, and raises the temperature to 400° C. when powered. The thermal head 11 is composed in an overall width W7 of about 600 mm along the principal scanning direction, when thermally recording in a recording paper in, for example, A2 format of the Japanese Industrial Standard in the longitudinal direction as the principal scanning direction. At this time, the heating resistance elements 13*a*, 13*b* at the outermost end portion on the head substrates 12*a*, 12*b* are defined to be spaced by a distance δ2 (for example 20 μm).

The heating resistance elements 13 are connected parallel to common electrodes 14 on every head substrate 12*a*, 12 *b*, and individual electrodes 15 are connected to the opposite side of the common electrodes 14 of the heating resistance elements 13. The individual electrodes 15 are connected to driving circuit elements 16 in every predetermined number of pieces, and plural signal lines 17 are connected to the plural driving circuit elements 16 for feeding the image data and control signals for printing on the heating resistance elements 13. The common electrodes 14, the individual electrodes 15, and the signal lines 17 are composed of metal such as aluminum Al and gold Au, and are formed by thin film technology or thick film technology.

Such head substrates 12*a*, 12*b* are installed, by a soft adhesive 18, in the configuration as described below, at the central positions 37, 38 along the principal scanning direction of the cooling plates 19*a*, 19*b*, to the cooling plates 19*a*, 19*b* formed in a rectangular plate form with a width W8 in the principal scanning direction, of a metal material having the coefficient of thermal coefficient relatively close to that of the head substrates 12*a*, 12*b* and an excellent thermal conductivity, such as Fe-Ni alloy of JIS C 2351 PB with the coefficient of thermal expansion of $$\alpha D = 0.70 \times 10^{-5} \cdot C^{-1} \quad \ldots (7)$$

and the cooling plates 19*a*, 19*b* with an overall width W9 along the principal scanning direction are fixed on the support plate 20 made of metal material such as Fe-Ni alloy.

Figure 5:
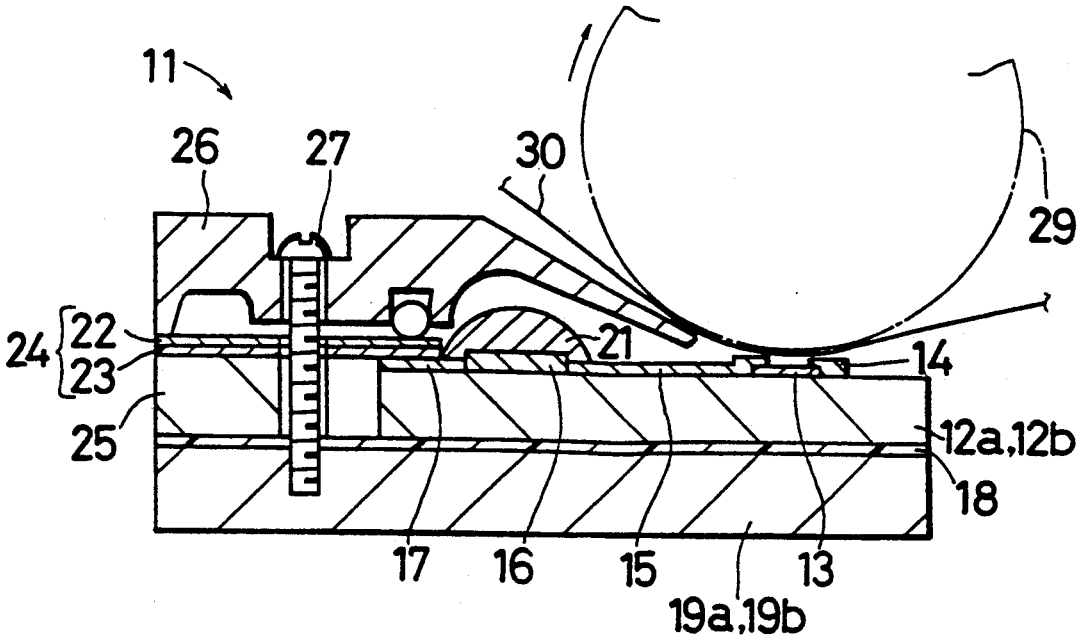
FIG. 5 is a sectional view near the thermal head 11.

FIG. 5 is an overall sectional view of the thermal head 11. The thermal head 11 has, in addition to the constitution described above, the driving circuit elements 16 covered with a protective layer 21. The area near the opposite ends of the driving circuit elements 16 of the signal lines 17 is connected to an elastic wiring substrate 24 having a circuit wiring 23 formed on an elastic film 22. This elastic wiring substrate 24 is disposed on the cooling plates 19*a*, 19*b* by soft adhesive 18 through a spacer 25. Besides, to cover a range from the individual electrodes 15 to the elastic wiring substrates 24, a head cover 26 is disposed, and the head cover 26, the elastic wiring substrate 24, and spacer 25 are fixed to the cooling plates 19*a*, 19*b* with screws 27.

Such thermal head 11 is disposed closely to a platen roller 29, and the heating resistance element 13 presses the thermal recording paper 30 on the platen roller 29 against the platen roller 29, while the heating resistance elements 13 are selectively energized and de-energized, desired printing is made.

Figure 6:
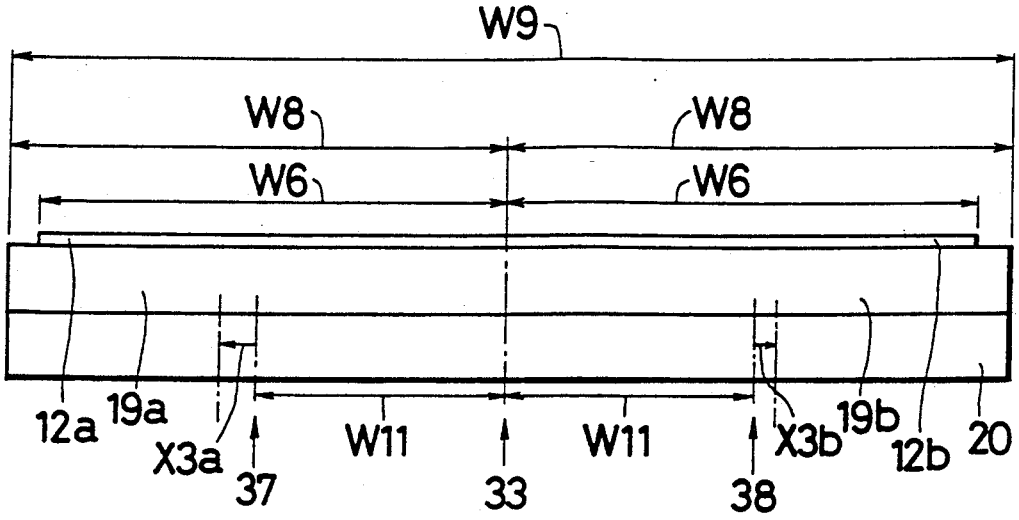
FIG. 6 is a sectional view over the entire length of the printing width of the thermal head 11.
Figure 7:
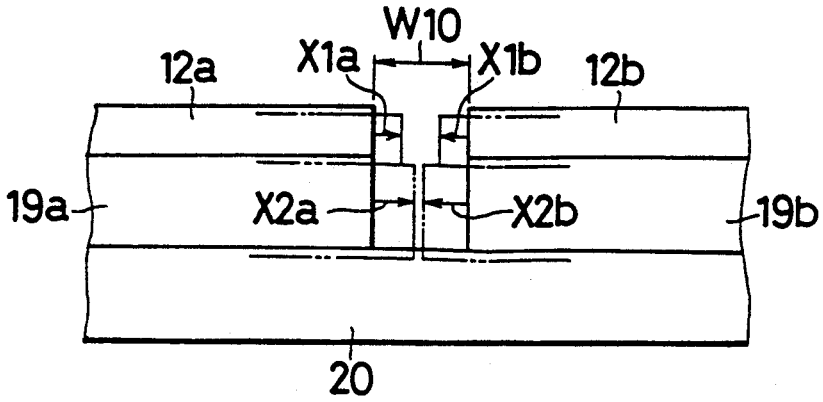
FIG. 7 is a diagram for explaining the principle of setting the projection length d in the dame embodiment.

FIG. 6 is a sectional view along the entire principal scanning direction of the thermal head 11, and FIG. 7 is a sectional view near the central position 33 of the thermal head 11 for explaining the action of this embodiment. They are mutually fixed at the central positions 37, 38 in the principal scanning direction of the cooling plates 19*a*, 19*b* remote from the central position 33 of the thermal head 11 by distance W11 (=W6/2). Therefore, along with the use of the thermal head 11, when the temperature changes from ordinary temperature of 25° C. to high temperature of 90° C., the expansion amounts x1a, x1b of the head substrates 12*a*, 12*b*, the expansion amounts x2a, x2b of the cooling plates 19*a*, 19*b*, and the expansion amounts x3a, x3b of the support plate 20 will be as shown in Table 3.

TABLE 3

| | Substrate | | Cooling plate | | Support plate | |
|---|---|---|---|---|---|---|
| | x1a | x1b | x2a | x2b | x3a | x3b |
| Coefficient of thermal expansion (°C.$^{-1}$) | $\alpha A = 0.73 \times 10^{-5}$ | | $\alpha D = 0.70 \times 10^{-5}$ | | | |
| Elongation (μm) | −71.2 | −71.2 | −68.3 | −68.3 | +68.3 | +68.3 |

It is known from Table 3 that the interval W10 of the head substrates 12*a*,12*b* is contracted by $$\Delta W10 = x3a + x1a + x3b + x1b = -5.8\ \mu m \quad \ldots (8)$$

Therefore, between the head substrates 12*a*, 12*b*, and the cooling plates 19*a*, 19*b*, a shearing force parallel to the principal scanning direction acts, but this shearing force is small enough as to be absorbed as an elastic deformation of the soft adhesive layer 18 intervening between the two. At this time, the ratio of the coefficients of thermal expansion αA, αD is $$\alpha A / \alpha D = 1.043 \quad \ldots (9)$$

Thus, in this embodiment, widening of the gap between the head substrates 12*a*, 12*b* may be prevented, and even if the thermal head 11 is heated to a high temperature, white-out due to widening of the gap as explained in relation to the prior art may be prevented.

In this embodiment, the head substrates 12*a*, 12*b* and the cooling plates 19*a*, 19*b* are only mutually affixed with soft adhesive layer 18, while the cooling plates 19*a*, 19*b* and the support plate 20 are fastened with screws. Therefore, as compared with the prior art of fixing the head substrate 12*a*, 12*b* with hard adhesive or mechanism so as not to separate, the manufacturing process is saved and the constitution is simplified.

Figure 8:
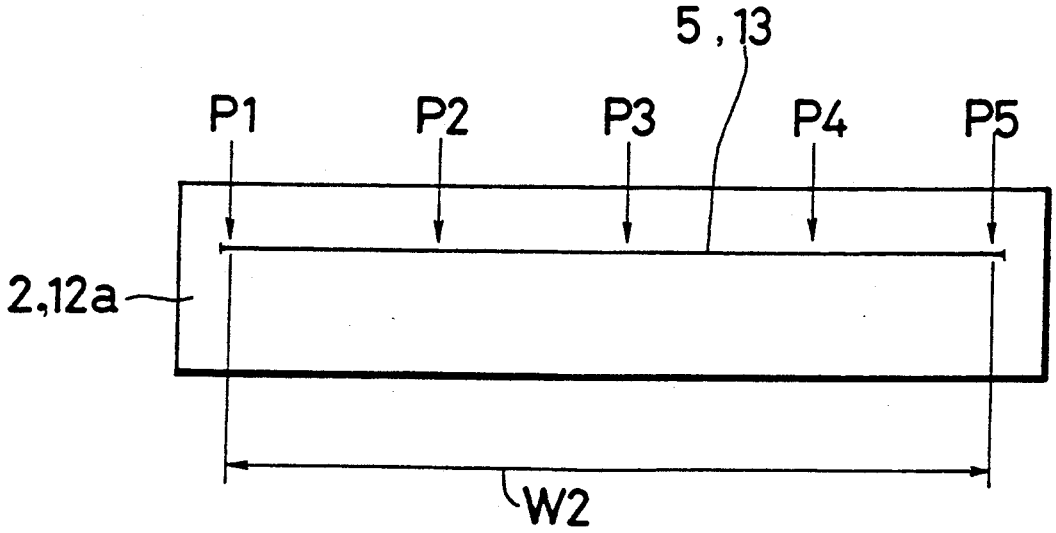
FIG. 8 is a plan view showing the warp measuring position of the thermal heads 1, 11.

FIG. 8 is a drawing referred to in the prior art, and it is also referred to in this embodiment. Concerning the linear heating resistance elements 13 on the head substrate 12*a*, same as in the prior art, the warp of the head substrate 12*a* was measured at five positions of equal intervals including the both ends in the principal scanning direction of the heating resistance elements 13. The results are shown in Table 4.

TABLE 4

| Cooling plate material | Temperature change | Wrap change due to temperature change (μm) | | | | |
|---|---|---|---|---|---|---|
| | | P1 | P2 | P3 | P4 | P5 |
| Fe—Ni alloy | 25° C. ↓ 90° C. | 0 | +1 | −3 | −2 | 0 |

Figure 9:
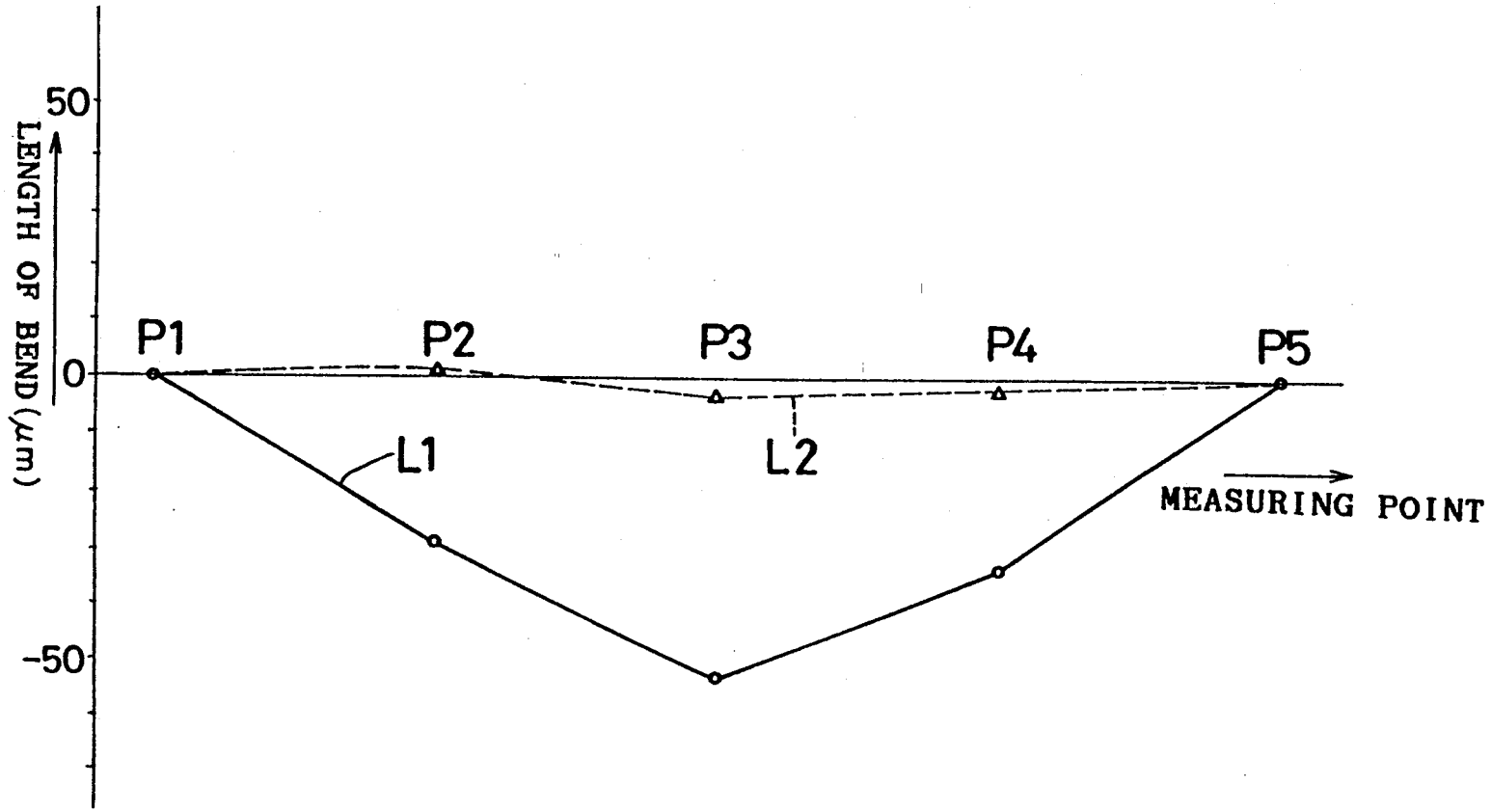
FIG. 9 is a graph showing the state at various temperatures of the thermal head 1, 11*a*.

Meanwhile, the warp state is indicated by broken line L2 in FIG. 9.

Thus, in the embodiment, the head substrates 12a, 12b can prevent uneven concentration due to uneven pressure in the principal scanning direction on the thermal recording paper 30 against the platen roller 29 by warping.

In this embodiment, relating to the coefficients of thermal expansion of the head substrates 12a, 12b, cooling plates 19a, 19b, and support plate 20, $\alpha$ ($=\alpha A$), $\beta$ ($=\alpha D$), $\gamma$ ($=\alpha D$), the materials are selected so as to satisfy the relation of $$\alpha \approx \beta \approx \gamma \quad \ldots (10)$$

but the materials are not limited to Fe-Ni alloy, but Cu-W alloy or Ti alloy (for example, JIS H 4600) may be used.

In this embodiment, it is intended to control the distance $\delta 2$ of the heating resistance elements 13a, 13b at the outermost end parts on the head substrates 12a, 12b shown in FIG. 4 at less than the alignment pitch $\delta 3$ of the heating resistance elements 3. As a result of the thermal head 11 of this embodiment, as far as the distance $\delta 2$ of the heating resistance elements 13a, 13b is less than the alignment pitch $\delta 3$ of the heating resistance elements 13, the white stripe (white-out) in thermal printing is not so obvious, and it is found to be obvious when becoming about 50 $\mu$m, exceeding the alignment pitch $\delta 2$ (for example, 40 $\mu$m).

If, the distance of 4 between the heating resistance elements 13a, 13b and the respective outermost end parts of the head substrates 12a and 12a, and the separation between the end faces 31a, 31b is about, for example, 10 $\mu$m respectively, white stripe is not so obvious until the separation between the end faces 31a and 31b is widened by about 20 $\mu$m. In such variations of the interval W10, it has been known that the coefficient of the thermal expansion $\gamma$ of the support plate 20 is increased about 15% with respect to the coefficient of thermal coefficient $\alpha$ of the head substrates 12a, 12b.

On the other hand, when the distance $\delta 4$ between the heating resistance elements 13a, 13b and the respective outermost end parts of the head substrate 12a, 12 b and the separation between the end faces 31a, 31b is substantially zero in the thermal head, it has been confirmed that the ratio of the coefficient of thermal expansion $\alpha$ and the coefficient of thermal expansion $\delta$ of the support plate 20 is permitted up to 20% increase. Therefore, corresponding to the type of structure of the thermal head, the ratio of the coefficient of thermal expansion $\alpha$ of the head substrates 12a, 12b and the coefficient of thermal expansion $\gamma$ of the support plate 20 is known to be selected as $$0.8 \leqq \alpha/\tau \leqq 1.2 \quad \ldots (11)$$

$$0.85 \leqq \alpha/\tau \leqq 1.15 \quad (12)$$

Figure 10:
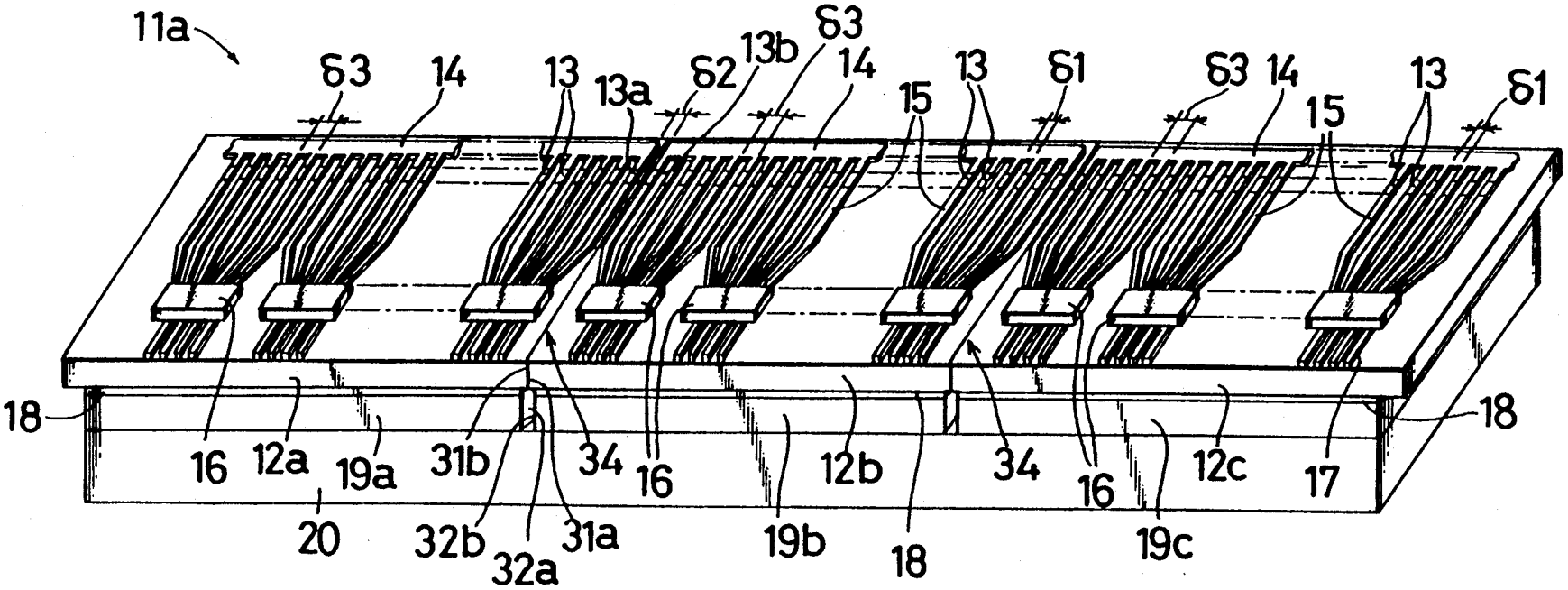
FIG. 10 is a perspective view of a thermal head 11*a* in other embodiment of the invention.
Figure 11:
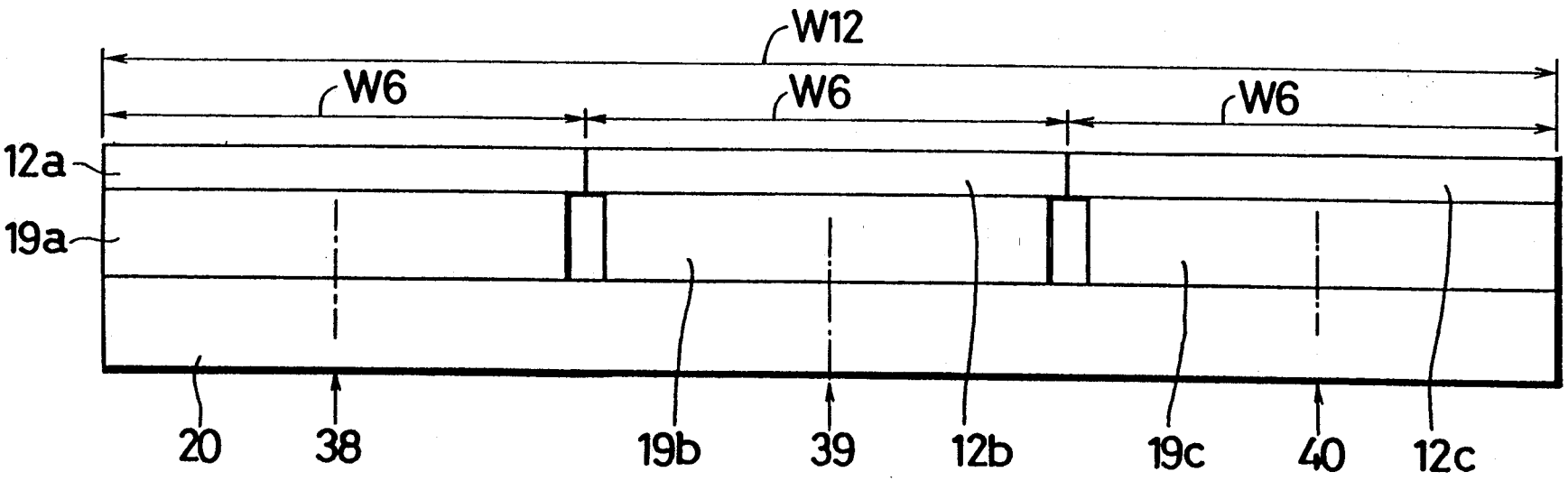
FIG. 11 is a sectional view of a thermal head 11*a*.

FIG. 10 is a perspective view of a thermal head 11a in other embodiment of the invention, and FIG. 11 is a sectional view along the overall length of the printing width of the thermal head 11a. This embodiment is similar to the foregoing embodiment, and corresponding parts are identified with same reference number. What is of note in this embodiment is that the thermal head 11a is composed of three head substrates 12a, 12b, 12c, and three cooling plates 19a, 19b, 19c, which are mutually adhered with a soft adhesive layer 18. The thermal head 11a of this embodiment is a combination of three head substrates 12a to 12c having the printing width W6 of the foregoing embodiment, and is intended to print on a recording paper of, for example, AO format of JIS, realizing an overall width of W12 (for example, 1000 mm). The cooling plates 19a to 19c are affixed to the support plates 20 with, for example, screws at the central positions 38, 39, 40 in the principal scanning direction. In this embodiment, the coefficient of thermal expansion $\alpha$ of the head substrates 12a to 12c, the coefficient of thermal expansion $\beta$ of the support plate 20, and the coefficient of thermal expansion $\gamma$ of the cooling plates 19a to 19c are selected to satisfy the relation of $$\alpha \approx \gamma < \gamma \quad \ldots (13)$$

As such materials, the head substrates 12a to 12c are made of ceramic material having the same coefficient of thermal expansion as the foregoing embodiment, the cooling plates 19a to 19c are made of aluminum (JIS H 4100, A6063-T5), and the support plate 22 is made of Fe-Ni alloy (JIS C 2531, PB), of which case is explained below.

Figure 12:
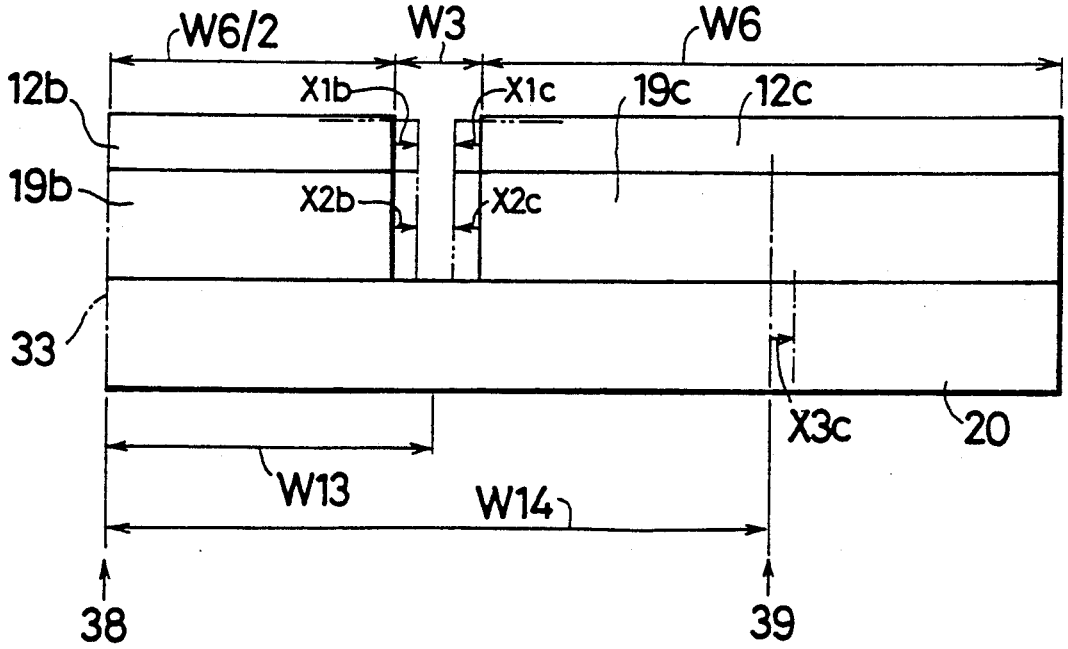
FIG. 12 is a partial sectional view of the thermal head 11*a*.

FIG. 12 is a sectional view for explaining the action of this embodiment. In this embodiment, the variation $\Delta W3$ due to temperature change of the gap W between the head substrates 12b, 12c is determined as follows $$\Delta W3 = x3c + x1c + x1b \quad \ldots (14)$$

on the basis of the variation amounts x1b, x2b, x3c of the head substrate 12b, cooling plate 19b and support plate 20 from the central position 33, and the variation amounts x1c, x2c of the head substrate 12c and the cooling plate 19c from the fixed position 39. Therefore, as a result of the experiment by the present invention on the change of the gap W3 same as in the foregoing embodiment, the findings are obtained as shown in Table 5.

TABLE 5

| | | Temperature change (°C.) | Coefficient of thermal expansion (1/°C.) | Elongation $\Delta x$($\mu$m) |
|---|---|---|---|---|
| Substrate | x1b<br>x1c | 65.0 | $0.73 \times 10^{-5}$ | 71.2 |
| Cooling plate | x2b<br>x2c | | $2.37 \times 10^{-5}$ | 231.1 |
| Support plate | x3c | | $0.70 \times 10^{-5}$ | 136.5 |

Elongation = coefficient of thermal expansion × temperature change × distance from reference position In this example, the variation of the gap W3 is $\Delta W3 = -5.9$ $\mu$m, and it means that 5.9 $\mu$m is contracted. The change of this extent is small enough to be absorbed by the elastic deformation of the soft adhesive layer 18 between the head substrate 12a to 12c and the cooling plates 19a to 19c. In such embodiment, too, the same effects as in the foregoing embodiment are achieved.

In the thermal head 11a of this embodiment, it is intended to suppress the gap W3 of the head substrates 12a to 12c at less that the alignment pitch $\delta 3$ of the heating resistance elements 13. Accordingly, the variation amount $\Delta W3$ of the gap W3 is controlled under the alignment pitch $\delta 1$ of the heating resistance elements 13. The principle for realizing such action is explained below. Concerning the coefficient of thermal expansion $\alpha$ of the head substrates 12a to 12c and the coefficient of thermal expansion $\gamma$ of the support plate 20, when the temperature changes from 25° to 90° C. by 65° C., the variation amounts x1b, x1c or the head substrates 12b, 12c shown in FIG. 12 are $$x1b = x1c = \alpha \times (W6/2) \times 65^\circ \text{ C.} = 9750\alpha \quad (15)$$

and the variation amount x3c of the support plate 20 is $$x3c = \gamma \times W14 \times 65^\circ \text{ C.} = 19500\gamma \quad (16)$$

Therefore, the variation amounts ΔW3 of the gap W3 is $$\Delta W3 = x3c - x1b - x1c = 19500(\gamma - \alpha) \quad (17)$$

Here, seeing $\alpha = 0.73 \times 10^{-5} \cdot C^{-1}$, and supporting $$\Delta W3 \leqq 20\ \mu m \quad \ldots (18)$$

equation (18) us modified as $$19500(\gamma - 0.73 \times 10^{-5}) \leqq 20 \times 10^{-3} \quad \ldots (19)$$

so that $$\gamma \leqq 0.832 \times 10^{-5} \cdot C^{-1} \quad \ldots (20)$$

is obtained. That is, as the coefficient of thermal expansion of the support plate 20, it is confirmed that $$0.73 \times 10^{-5} \leqq \gamma \leqq 0.832 \times 10^{-5} \quad \ldots (21)$$

is desired.

The invention may be executed in a wide range of metal materials, not limited to the materials presented in the foregoing embodiment, as fast as the material possesses the coefficient of thermal expansion $\gamma$ expressed in equation (21).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are thereof intended to be embraced therein.

What is claimed is:

1. A thermal head defining a principal scanning direction, comprising:

a support member;

a plurality of cooling member, each adjacent two of the cooling members being symmetrically mounted on the support member about a center therebetween, each of the cooling members being affixed to the support member at a location equidistant from the center along the principal scanning direction; and a plurality of ceramic head substrates each having multiple heating resistance elements mounted thereon, each of the head substrates having a predetermined width along the principal scanning direction and being attached to each of the cooling members, wherein said equidistance is approximately one half of said predetermined width;

wherein each of the head substrates has a coefficient of thermal expansion $\alpha$ and the support member has a coefficient of thermal expansion $\tau$, the coefficient of of thermal expansion $\alpha$ and the coefficient of thermal expansion $\tau$ having a relation defined as:

$$0.8 \leqq \alpha/\tau \leqq 1.2.$$

2. A thermal head of claim 1, wherein the cooling members are made of a metal material having a coefficient of thermal expansion which is substantially identical with the coefficient of thermal expansion of $\tau$ of the support member.

3. A thermal head of claim 1, wherein the head substrates are adhered to cooling members with a soft adhesive, and the cooling members are affixed to the support member.

4. A thermal head of claim 1, wherein at least two of the adjacent head substrates have first end faces opposing to each other, and the cooling members on which the adjacent two head substrates are mounted have second end faces opposing to each other, said first end faces projecting from the opposing second end faces of the cooling members.

5. A thermal head of claim 1, wherein each of the cooling members has a coefficient of thermal expansion, and the coefficient of thermal expansion of the support member is less than the coefficient of thermal expansion of each of the cooling members, and the coefficient of thermal expansion of each of the head substrates is substantially identical to the coefficient of thermal expansion of the support member.

6. A thermal head of claim 1, wherein the head substrates are made from ceramics and the cooling members are made from aluminum.

7. A thermal head defining a principal scanning direction, comprising:

a support member;

at least two cooling members carried by the support member and spaced from each other in the principal scanning direction to define a center of spacing, each of said cooling members being coupled to the support member at a location equidistant from the center of spacing along the principal scanning direction;

at least two head substrates, each of said head substrates being carried by one of said cooling members; and a plurality of heating resistance elements carried by each of the head substrates;

wherein each of said head substrates has a coefficient of thermal expansion $\alpha$ and the support member has a coefficient of thermal expansion $\tau$, the coefficient of thermal expansion $\alpha$ and the coefficient of thermal expansion $\tau$ having a relation defined as $0.8 \leqq \alpha/\tau \leqq 1.2$.

8. A thermal head according to claim 7, wherein the coefficient of thermal expansion $\alpha$ of each of the head substrates and the coefficient of thermal expansion $\tau$ of the support member are substantially the same value.

9. A thermal head according to claim 7, wherein each of the head substrates is formed from ceramics and the support member is formed from a metal material.

10. A thermal head according to claim 9, wherein each of the head substrates is formed from ceramics, each of the cooling members is formed from aluminum, and the support member is formed from an Fe-Ni alloy.

11. A thermal head according to claim 9, wherein each of the head substrate is formed from ceramics, each of the cooling members is formed from an Fe-Ni alloy, and the support member is formed from an Fe-Ni alloy.

12. A thermal head defining a principal scanning direction, comprising:

a support member;

at least two cooling members carried by the support member and spaced from each other in the principal scanning direction to define a center of spacing, each of the cooling members having a predetermined width along the principal scanning direction and being coupled to the support member at a location equidistant from the center of spacing along the principal scanning direction;

at least two head substrates, each of the head substrates having an upper surface and a lower surface and being carried by each of the cooling members;

a plurality of heating resistance elements carried by each of the head substrates; and a soft adhesive layer for bonding the lower surface of each of the head substrates to each of the cooling members along a substantially entire length of the predetermined width of each of the cooling members;

wherein each of said head substrates has a coefficient of thermal expansion $\alpha$ and the support member has a coefficient of thermal expansion $\tau$, the coefficient of thermal expansion $\alpha$ and the coefficient of thermal expansion $\tau$ having a relation defined as $0.8 \leqq \alpha/\tau \leqq 1.2$.

13. A thermal head according to claim 12, wherein the coefficient of thermal expansion $\alpha$ of each of the head substrates and the coefficient of thermal expansion $\tau$ of the support member have substantially the same value.

14. A thermal head according to claim 12 wherein each of the head substrates is formed from ceramics and the support member is formed from a metal material.

15. A thermal head according to claim 12, wherein each of the head substrates is formed from ceramics, each of the cooling members is formed from aluminum, and the support member is formed from an Fe-Ni alloy.

16. A thermal head according to claim 12, wherein each of the head substrates is formed from ceramics, each of the cooling members is formed from an Fe-Ni alloy, and the support member is formed from an Fe-Ni alloy.

17. A thermal head defining a principal scanning direction, comprising:

a support member;

at least two cooling members spaced from each other in the principal scanning direction;

at least two head substrates, each of said head substrates being carried by one of said cooling members; and a plurality of heating resistance elements carried by each of the head substrates at a predetermined alignment pitch, wherein adjacent two of the heating resistance elements, each carried on a different ceramic head substrate, are spaced a predetermined distance from each other at a first temperature;

wherein each of said head substrates has a coefficient of thermal expansion $\alpha$ and the support member has a coefficient of thermal expansion $\tau$, the coefficient of thermal expansion $\alpha$ and the coefficient of thermal expansion $\tau$ having a relationship defined as: $0.8 \leqq \alpha/\tau \leqq 1.2$ so that the predetermined distance between the two adjacent heating resistance elements carried by different head substrates is smaller than said alignment pitch at a second temperature higher than said first temperature.

18. A thermal head according to claim 17, wherein the coefficient of thermal expansion $\alpha$ of the head substrate and the coefficient of thermal expansion $\tau$ of the support member have substantially the same value.

19. A thermal head according to claim 17, wherein each of the cooling members has a coefficient of thermal expansion $\beta$ and wherein the coefficient of thermal expansion $\alpha$ of the head substrate, the coefficient of thermal expansion $\beta$ of the cooling member, and the coefficient of thermal expansion $\tau$ of the support member have substantially the same value.

20. A thermal head according to claim 17, wherein each of the cooling members has a coefficient of thermal of thermal expansion $\beta$ and wherein the coefficient of thermal of thermal expansion $\beta$ is larger than the coefficient of thermal expansion $\alpha$ of the cooling member, and the coefficient of thermal expansion $\alpha$ of the head substrate or the coefficient of thermal expansion $\tau$ of the support member.

21. A thermal head according to claim 17, wherein each of the head substrates is formed from ceramics and the support member is formed from a metal material.

22. A thermal head according to claim 17, wherein each of the head substrates is formed from ceramics, each of the support member is formed from aluminum, and the support member is formed from an Fe-Ni alloy.

23. A thermal head according to claim 17, wherein each of the head substrates is formed from ceramics, each of the support member is formed from an Fe-Ni alloy, and the support member is formed from an Fe-No alloy.

24. A thermal head according to claim 17, wherein each of the head substrates is adhered to each of the cooling members with a soft adhesive.

* * * * *